US008661961B2

(12) United States Patent
Rosenberg et al.

(10) Patent No.: US 8,661,961 B2
(45) Date of Patent: Mar. 4, 2014

(54) ENERGY FOCUSING SYSTEM FOR ACTIVE DENIAL APPARATUS

(75) Inventors: James Jordan Rosenberg, Monrovia, CA (US); Michael Peter DeLisio, Monrovia, CA (US); Blythe Chadwick Deckman, Corona, CA (US); Michael Loren Aronson, Leucadia, CA (US)

(73) Assignee: Wavestream Corporation, San Dimas, CA (US)

( * ) Notice: Subject to any disclaimer, the term of this patent is extended or adjusted under 35 U.S.C. 154(b) by 0 days.

(21) Appl. No.: 13/374,227

(22) Filed: Dec. 16, 2011

(65) Prior Publication Data

US 2012/0097867 A1 Apr. 26, 2012

Related U.S. Application Data

(62) Division of application No. 12/070,801, filed on Feb. 20, 2008, now Pat. No. 8,453,551.

(60) Provisional application No. 60/902,319, filed on Feb. 20, 2007.

(51) Int. Cl.
*F41H 13/00* (2006.01)

(52) U.S. Cl.
USPC ..... 89/1.11; 250/503.1

(58) Field of Classification Search
USPC ..... 89/1.11; 42/1.08, 84; 343/772, 776, 343/777, 778, 779; 342/13; 250/492.1, 250/503.1
See application file for complete search history.

(56) References Cited

U.S. PATENT DOCUMENTS

| | | | | |
|---|---|---|---|---|
| 4,339,757 | A | 7/1982 | Chu | |
| 4,553,068 | A * | 11/1985 | Brandt | 315/4 |
| 5,317,173 | A * | 5/1994 | Sovero | 257/197 |
| 5,422,596 | A | 6/1995 | Armstrong et al. | |
| 5,837,918 | A | 11/1998 | Sepp | |
| 6,766,793 | B2 | 7/2004 | MacDougall | |
| 6,950,021 | B2 * | 9/2005 | Butler | 340/545.3 |
| 7,490,538 | B2 * | 2/2009 | Lowell et al. | 89/1.11 |
| 2002/0011963 | A1 | 1/2002 | Koslover | |
| 2007/0040725 | A1 * | 2/2007 | Lowell et al. | 342/13 |

OTHER PUBLICATIONS

International Search Report for Application PCT/US2008/02199, dated Jun. 25, 2008.
European Search Report for Application No. 09014019.5-1260 / 2151663, dated Sep. 2, 2011.
Active Denial Technology, AFRL's Directed Energy Directorate, High Power Microwave Division, Application Branch, Kirtland AFB NM, dated Jan. 22, 2007.

* cited by examiner

*Primary Examiner* — Bret Hayes
(74) *Attorney, Agent, or Firm* — Lazaris IP

(57) ABSTRACT

An active denial apparatus for use in non-lethal weaponry includes at least one focusing element configured to focus millimeter-wave energy along an axis of propagation. The at least one focusing element includes an astigmatic or dual axis focusing system configured to direct a focused beam that allows the active denial apparatus to accurately immobilize targets at both close and long range within acceptable limits of intensity.

15 Claims, 6 Drawing Sheets

ENERGY FOCUSING SYSTEM FOR ACTIVE DENIAL APPARATUS

CROSS-REFERENCE TO RELATED AND PRIORITY PATENT APPLICATIONS

This application is a divisional application of U.S. patent application Ser. No. 12/070,801, filed Feb. 20, 2008. This application also claims priority to U.S. Provisional Patent Application No. 60/902,319, filed Feb. 20, 2007. This non-provisional patent application is also related to a PCT Patent Application No. PCT/US2008/002199, filed on Feb. 20, 2008.

FIELD OF THE INVENTION

The present invention generally relates to active denial systems for non-lethal weapons. Specifically, the present invention relates to the use of directed electromagnetic power to generate sufficiently unpleasant sensations in targeted subjects to affect behavior or incapacitate the subject without causing significant physical harm.

BACKGROUND OF THE INVENTION

Existing active denial systems involve the use of millimeter-waves, directed onto the subject using a focusing system such as a focusing reflector, lens, flat-panel array antenna, or phased-array system. The properties of these existing focusing systems can be described in terms of a traditional rectangular Cartesian coordinate system, with x, y, and z axes. Where the direction of propagation of a beam is centered along the z-axis, traditional focusing systems cause the beam to converge or diverge approximately equally in both x and y directions. If the beam is converging as it leaves the aperture of the device, it will come to a focus—a plane of minimum extent in x and y—at some particular location along the z-axis. As the beam propagates beyond this point, the beam will diverge.

Generally, over the distances over which these devices are effective, atmospheric absorption of millimeter waves is small, so the average power density in the beam at any location along the z-direction is given by the total power emitted by the device divided by the effective area of the beam (since the beam intensity will not simply drop to zero at some distance in x or y away from the z-axis, the "boundary" of the beam is usually defined, for example, as the contour at which the intensity of the beam falls to $1/e^2$ of its peak intensity along the z-axis). In the case in which the beam is converging as it leaves the device aperture, the beam will have a plane of maximum intensity (at the plane of minimum beam area) with decreasing intensity at locations in the z-direction that are either further away from or nearer to the device than the plane of maximum intensity.

One issue with the variation of intensity with distance along the beam is that there is a range of intensity or power density that is useful in the active denial application. There is a minimum power density below which the subject is not adequately deterred, and a maximum power density above which the beam can cause damage to tissue. Generally, it is preferable that no portion of the beam have an intensity exceeding the damage threshold. The beam will always have a maximum distance beyond which the intensity falls below the effectiveness threshold, but in some configurations in which the beam is converging along both the x and y axes as it leaves the aperture of the apparatus that generates and emits the beam, there will also be a minimum distance from the apparatus within which the beam intensity falls below the effectiveness threshold. Therefore, one must consider the beam intensity with regard to distance from the device for uses such as crowd control or close-range situations.

The distance over which a traditionally focused electromagnetic beam can remain effectively collimated (i.e., not significantly converging nor diverging) is related to the wavelength and the effective diameter of the beam. FIG. 1(*a-d*) show beam diameters and power densities as a function of distance of propagation away from the device for several prior art devices having "circular" focusing elements (i.e., that generate beams that depend only upon distance along the z-axis and radial distance away from the z-axis, but not upon angle around planes parallel to the x-y plane). FIGS. 1(*a*) and (*b*) show the evolution of beam diameter and power density for devices having 1 meter diameter apertures, one focused so as to create a maximum beam intensity at a distance of 100 meters from the device and the other configured to be collimated at the plane of the aperture. For simplicity of comparison, each beam intensity curve is shown normalized to a peak power density of 1 W/cm$^2$. The associated total power requirements to transmit the beams shown are 3.9 kW (per W/cm$^2$) for the collimated beam, and 675 W (per W/cm$^2$) for the focused beam. Using a focused beam allows a greater than five-fold reduction in required peak power, but with these focal conditions the focused device will likely be ineffective for distances substantially less than 50 meters. The device could be dynamically refocused to a shorter distance to address a closer subject (or a subject moving toward the device), but this adds to system complexity. FIGS. 1(*c*) and (*d*) show similar plots to those of (a) and (b), but for devices having a 0.3 meter diameter aperture. The focused device is configured to place the maximum intensity plane at a distance of 10 meters from the device. Again the curves are normalized to a maximum peak intensity of 1 W/cm$^2$. The associated total power requirements to transmit the beams shown are 360 W (per W/cm$^2$) for the collimated beam, and 75 W (per W/cm$^2$) for the focused beam. Here, the collimated beam requires slightly less than 5 times as much power, but again, the focused beam is likely to fall below effective power densities at distances of less than 5 meters unless dynamic focusing is used. The collimated systems have greater "depth of field" (defined here as the range of distance over which the beam maintains a usable power density) than the focused systems, but the collimated systems require much more total output power to reach effective power densities at any distance.

This disclosure describes approaches to improve the effective depth of field as defined above, while reducing the total output power required to achieve effective power densities over a broader range of distances. These approaches can be combined or used separately.

SUMMARY OF THE INVENTION

The present invention uses a millimeter-wave source in conjunction with astigmatic focusing (i.e., beam-processing elements having different effective apertures or different focal lengths in the x and y directions as described above, or both) to produce an active denial system with greater depth of field (as defined above) for a given peak output power than such a system using conventional focusing. The astigmatic or "dual-axis focusing" focusing system allows the generation of a beam that is, for example, diverging in the x-direction, while initially converging in the y-direction. Such a beam can maintain an effective area that remains more nearly constant over a much greater distance along the axis of propagation (the z-axis as described above) than a beam generated with conventional focusing that initially converges the beam in both x and y directions. This means that the power density in the beam will remain more nearly constant over a much greater distance along the axis of propagation. This "depth of focus" approach represents a significant and very important improvement over existing active denial systems. FIG. 2 illustrates the profile of such a beam as a function of distance along the direction of propagation. Note that the x-direction and y-direction need not explicitly denote vertical and horizontal directions, merely two mutually orthogonal directions each orthogonal to the axis of propagation (the z-axis).

Additionally, by incorporating the ability to alternate the focusing properties between two fixed focus settings having different effective apertures and focal lengths (or sequence through more than two such settings), the device can generate peak power densities suitable to generate the active denial effect at different ranges alternately (or sequentially), thereby reducing the peak output power required to generate the effect at each of the distances. Provided the reduced duty cycle coverage of each of the distance ranges provides adequate effect in the situation in which the device is used, this technique further reduces the total peak output power requirement.

It should be understood that the focusing system may comprise a wide range of beam-forming techniques, including, but not limited to, shaped reflective surfaces, transmissive lenses, and arrays of individual radiators, collectively phased to produce a desired wavefront shape.

The present invention therefore includes an active denial apparatus comprising a high-power millimeter wave source and at least one beam-processing element for directing millimeter-wave energy along an axis of propagation, the at least one beam-processing element comprising an astigmatic focusing system configured to direct a focused beam having a focusing profile in a plane defined by a x-axis and a z-axis that includes an axis of propagation, and a substantially different focusing profile in a plane defined by a y-axis and the z-axis also including the axis of propagation that is perpendicular to the x-plane.

The present invention also includes an active denial apparatus comprising a high-power millimeter wave source and at least one beam-processing element for directing millimeter wave energy along an axis of propagation, the at least one beam-processing element including a variable focusing system configured to be cycled through at least two focusing configurations.

The present invention further includes a method of focusing energy in an active denial apparatus comprising generating millimeter-wave energy from a high-power millimeter-wave source and directing the millimeter-wave energy along an axis of propagation, wherein at least one beam processing element for directing the millimeter-wave energy includes an astigmatic focusing system configured to direct a focused beam with a focusing profile in a plane defined by a x-axis and a z-axis, which contains an axis of propagation, the z-axis, and a substantially different focusing profile in a plane defined by a y-axis and the z-axis, which contains the axis of propagation, the z-axis, and is perpendicular to the plane defined by the x-axis and the z-axis.

The present invention further includes an active denial apparatus comprising a high power millimeter-wave source and at least one beam processing element combined in an array having at least one elements that directly generates millimeter-wave energy with a desired set of beam profiles in a plane defined by an x-axis and a z-axis and a plane defined by a y-axis and the z-axis.

The foregoing and other aspects of the present invention will be apparent from the following detailed description of the embodiments, which makes reference to the several figures of the drawings as listed below.

BRIEF DESCRIPTION OF THE DRAWINGS

FIG. 1(*b*) is a graphical representation of power density as a function of propagation distance for a 3.9 kW total power for the collimated beam and for 675 W for the focused beam;

FIG. 1(*c*) is a graphical representation of beam diameter as a function of propagation distance for a 0.3 meter diameter both collimated at the aperture and focused for minimum beam diameter at a distance of 10 meters from the aperture;

FIG. 1(*d*) is a graphical representation of power density as a function of propagation distance for the 0.3 meter aperture for 360 W total output power for the collimated beam and 75 W total output power for the focused beam;

DETAILED DESCRIPTION OF THE EMBODIMENTS

Figure 1A:
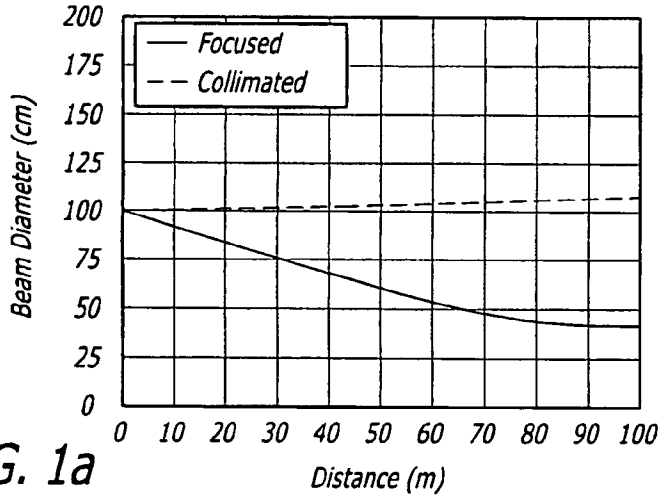
FIG. 1(*a*) is a graphical representation of beam diameter as a function of propagation distance for a 1 diameter meter aperture both collimated at the aperture and focused for minimum beam diameter at 100 meters.
Figure 1B:
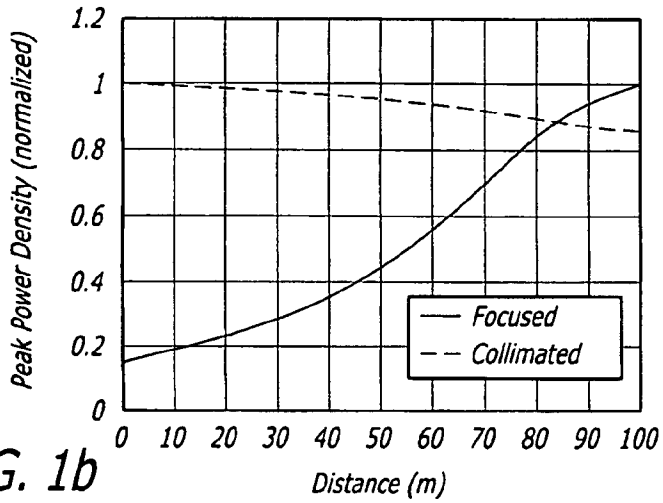
Figure 1C:
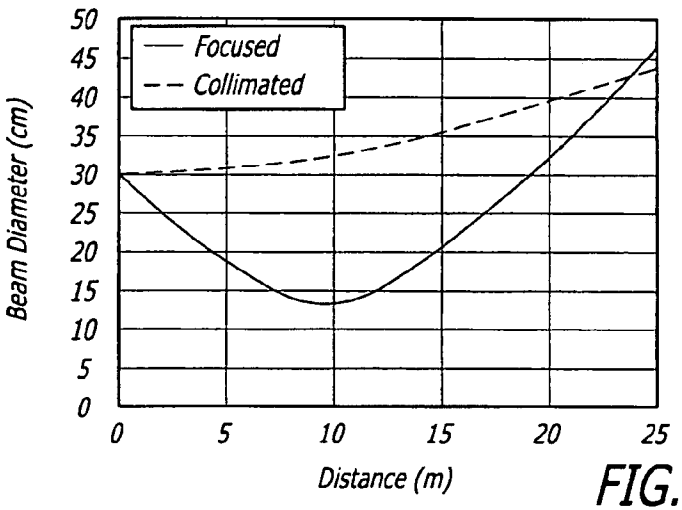
Figure 1D:
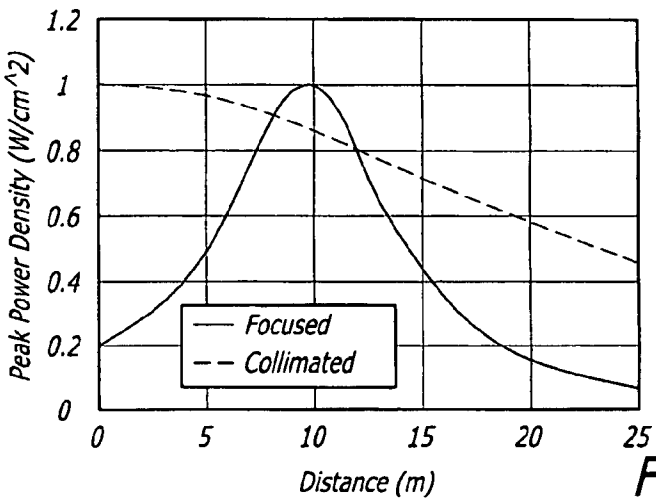
Figure 2:
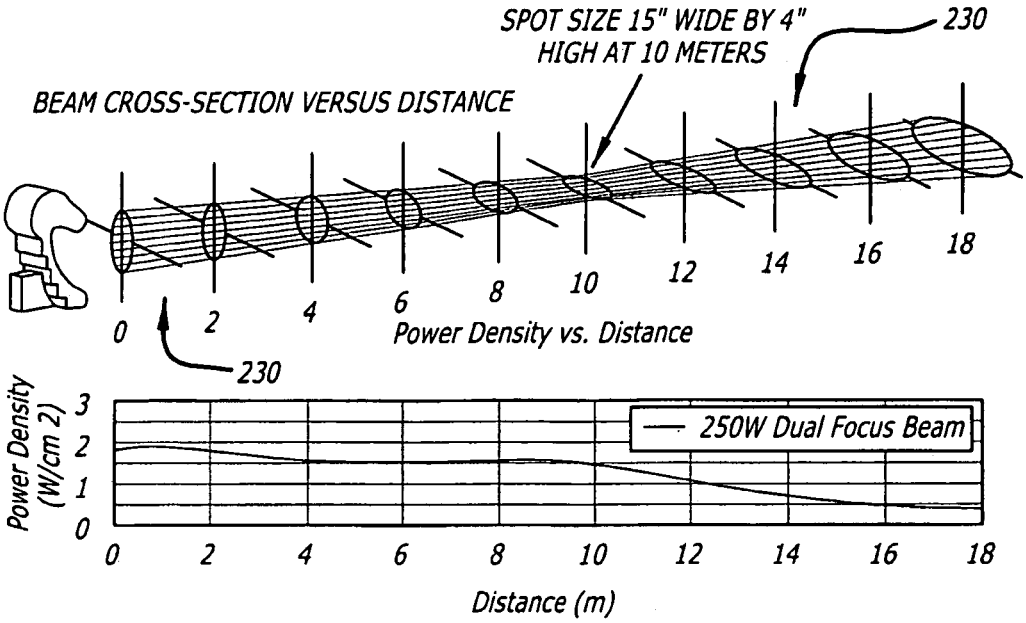
FIG. 2 is a pictorial and graphical representation of beam profile and power density versus propagation distance for an astigmatic focusing system according to the present invention.

In the following description of the present invention reference is made to the accompanying drawings which form a part thereof, and in which is shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

The present invention comprises, according to one embodiment, an active denial apparatus 100 that includes a millimeter-wave source 110 and at least one beam-processing element which comprises an astigmatic or dual-axis focusing system 200. Together, the millimeter wave source 110 and the astigmatic focusing system 200 comprise a means for directing millimeter-wave energy to a desired target. In one embodiment of the present invention, the at least one beam processing element of the astigmatic or dual-axis focusing system 200 uses a main reflector 210 to provide the final focusing, and a sub-reflector 220 to match the size and divergence of the waves emanating from the millimeter-wave source 110 to the main reflector 210 so as to achieve the desired convergence and divergence of the wave in the x and y directions. Application of the astigmatic focusing system 200 to an active denial apparatus 100 in this type of configuration results in a broadening of the depth of focus and therefore an increase in a usable range of the device.

Figure 4:
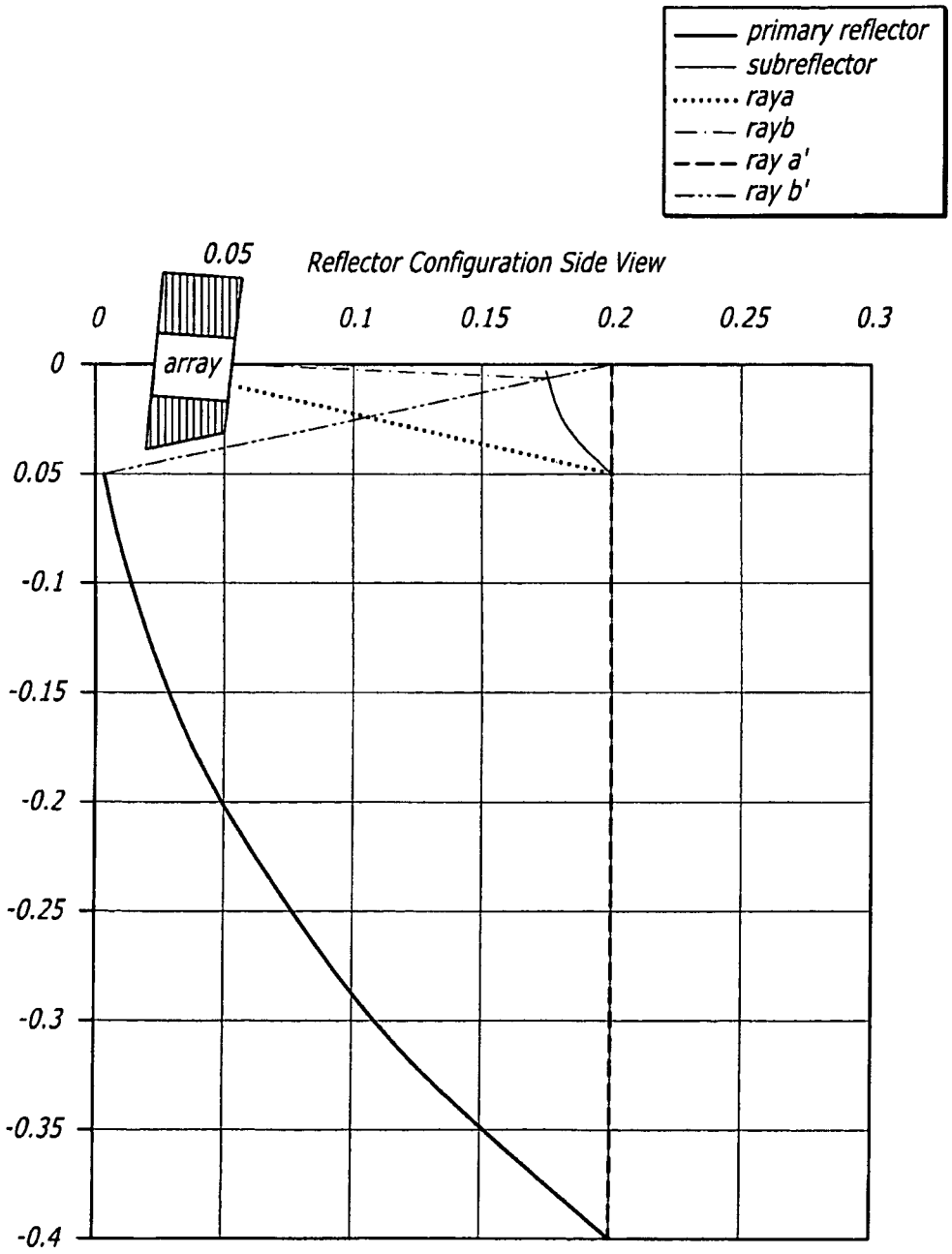
FIG. 4 is a cross-sectional side view of a reflector configuration of an astigmatic focusing system in which focusing elements are uncurved in the direction perpendicular to the page, and ~0.1 meter in extent in that direction.

FIG. 4 shows a side-view cross-section of the focusing elements and the millimeter-wave source 110 in the active denial apparatus 100. FIG. 4 shows the configuration of main reflector 210 and sub-reflector 220 according to one embodiment of the present invention. Main reflector 210 and sub-reflector 220 may be configured in a variety of different ways to produce different focal lengths. Additionally, although depicted in FIGS. 4-6 as reflectors, it should be noted that these focusing elements may include lenses, flat panel antennas, phased arrays, mirrors, and any other reflective components that allow waves emanating from the millimeter-wave source 110 to achieve the desired convergence and divergence of the wave in the x and y directions.

The millimeter-wave source 110 may be compact, and could be realized using solid-state grid amplifier and/or grid oscillator technology to obtain a high power beam. A useful beam profile can be obtained with the natural divergence of a beam that is collimated in the horizontal direction with a 0.1 meter aperture (i.e., 0.1 meter extent in the x-direction), and converged to a minimum extent in the y-direction at a distance of ~11 meters using an aperture that extends 0.35 meters in the y-direction.

Figure 3:
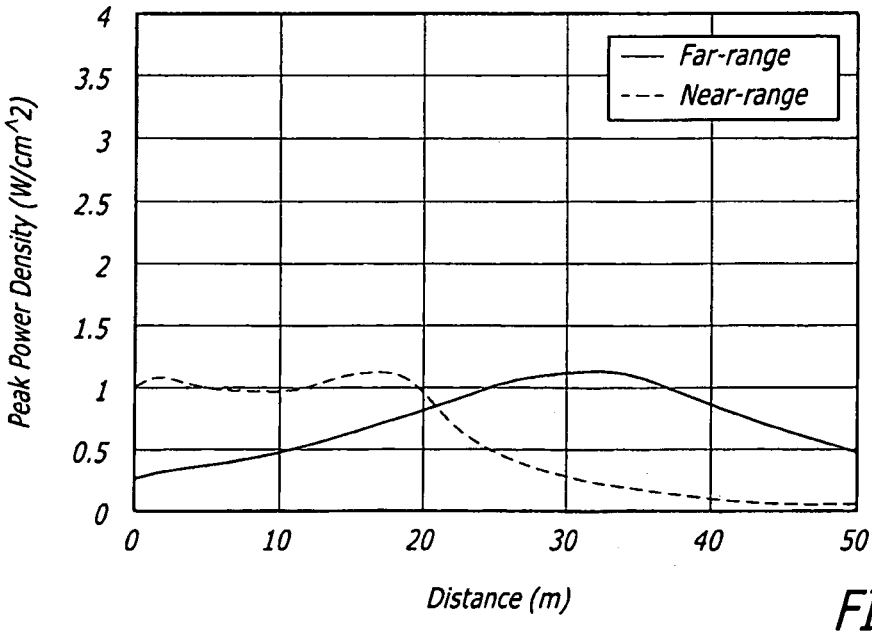
FIG. 3 is a graphical representation of power density versus distance for far-range and near-range settings of a two-setting astigmatic focusing system with 300 W total output power.
Figure 5:
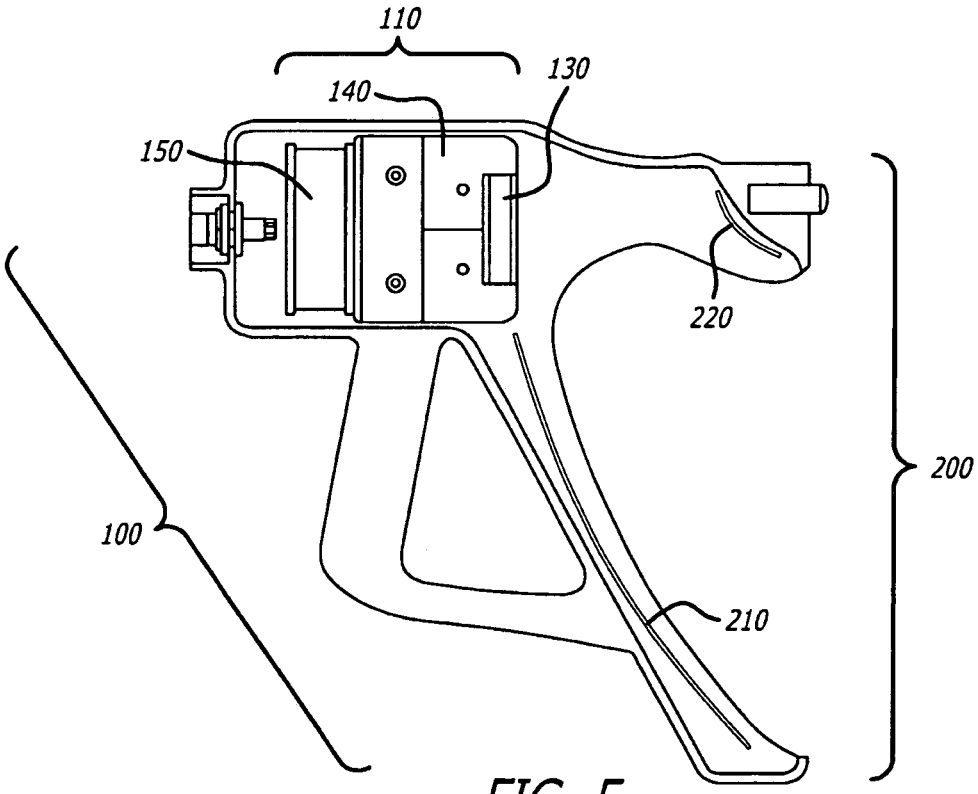
FIG. 5 is a conceptual drawing of a handheld unit employing an astigmatic focusing system according to one embodiment of the present invention.
Figure 6:
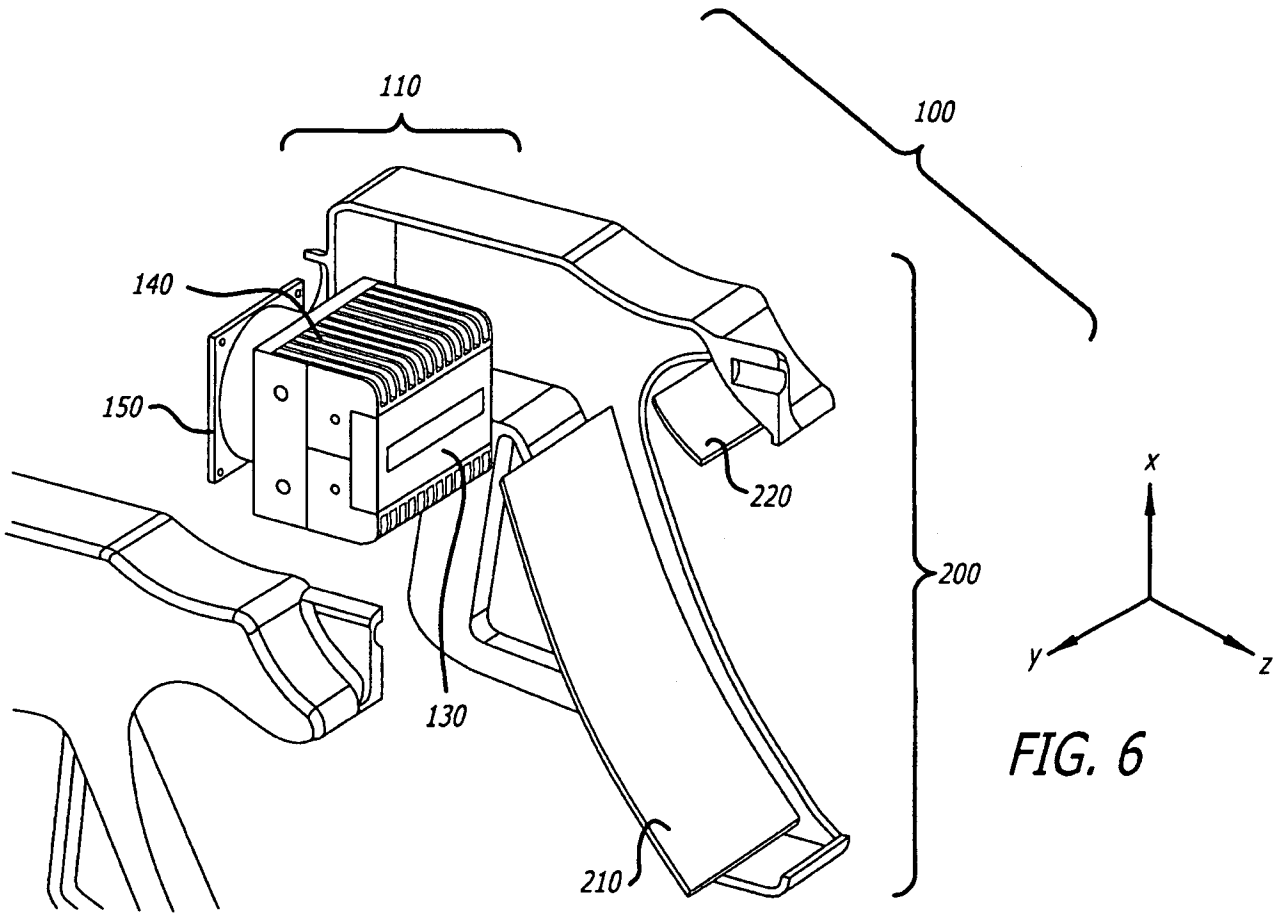
FIG. 6 is an exploded view of a handheld unit employing an astigmatic focusing system according to one embodiment of the present invention.

FIG. 5 shows the active denial apparatus 100 as a handheld unit according to another embodiment of the present invention. It should be noted that the astigmatic or dual-axis focusing system 200 described herein can be scaled to any sized system. The two main components of the active denial apparatus 100 according to FIG. 5 are the high-power millimeter-wave source 110 and the at least one beam processing element comprising the astigmatic focusing system 200. In this embodiment, the high-power millimeter wave source 110 comprises a solid-state grid oscillator 130, with an associated heat sink 140 and a cooling fan 150. It is understood that the high-power millimeter-wave source 110 may comprise other types of solid-state or vacuum-tube-based sources. Millimeter-wave energy is radiated from the high-power millimeter-wave source 110 to the beam-processing element of the astigmatic focusing system 200. The beam processing element comprises a main reflector 210 and a sub-reflector 220, which in the embodiment of FIG. 5 are shaped reflective surfaces. These reflectors 210 and 220 make up the astigmatic or dual-axis focusing system 200 that directs a focused beam with a focusing profile 230 which contains the axis of propagation, the z-axis, in both the xz and yz planes. Reflectors 210 and 220 are shaped in such a way such that the focusing profile 230 of the beam in the xz plane is substantially different from the focusing profile 230 of the beam in the yz plane. In the embodiment shown in FIG. 5, the reflectors 210 and 220 curve very little along one direction, while their curvature in the other direction is much more pronounced. This reflector configuration is the same as that depicted in FIG. 4, and will give rise to a beam with a near constant cross section over a wide depth of field, as shown in FIG. 3. FIG. 6 is an exploded view of an active denial apparatus 100 employing an astigmatic focusing system 200 according to the present invention. The exploded view of FIG. 6 clearly depicts the multi-reflector configuration discussed above and the solid-state oscillator 130, associated heat sink 140, and cooling fan 150.

FIG. 3 shows a plot of power density versus distance for a two-setting device having a near-range setting and a far-range setting. Each setting uses dual-axis focusing with different aperture sizes and effective focal lengths in both x and y directions. By rapidly alternating between these two settings, the device can produce a nearly constant 1 W/cm$^2$ intensity at 50% duty cycle over a distance from zero to forty meters for every 300 W of total output power. The ability to alternate the focusing properties between two fixed focus settings having different effective apertures and focal lengths (or sequence through more than two such settings) generates peak power densities suitable to achieve the active denial effect at different ranges alternately (or sequentially) and results in a reduction of the peak output power required to generate the effect at each of the distances.

The astigmatic focusing system 200 can be configured to broaden the depth of focus in a variety of ways. For example, the components of the at least one beam processing element can be selected to direct a focused beam with an effective cross-sectional area that is substantially constant over a wide range in the direction of propagation. In another example, the at least one beam processing element may be configured so that the focusing profile 230 diverges in the plane defined by the x-axis and the z-axis (the xz-plane) and converges in the plane defined by the y-axis and the z-axis (the yz-plane.) In yet another example, the at least one beam processing element may be configured so that the focusing profile 230 converges in both the xz and yz plane. The astigmatic focusing system 200 may also be thought of as a variable focusing system configured to include the focusing configurations discussed herein and to be cycled through one or more of those focusing configurations.

One skilled in the art will recognize that beam processing realized by shaped reflectors can equally be realized using shaped transmissive lenses. Alternative embodiments in which the beam processing is realized by a combination of transmissive lenses and shaped reflectors, or realized using only transmissive lenses are also included within the present invention.

Figure 7:
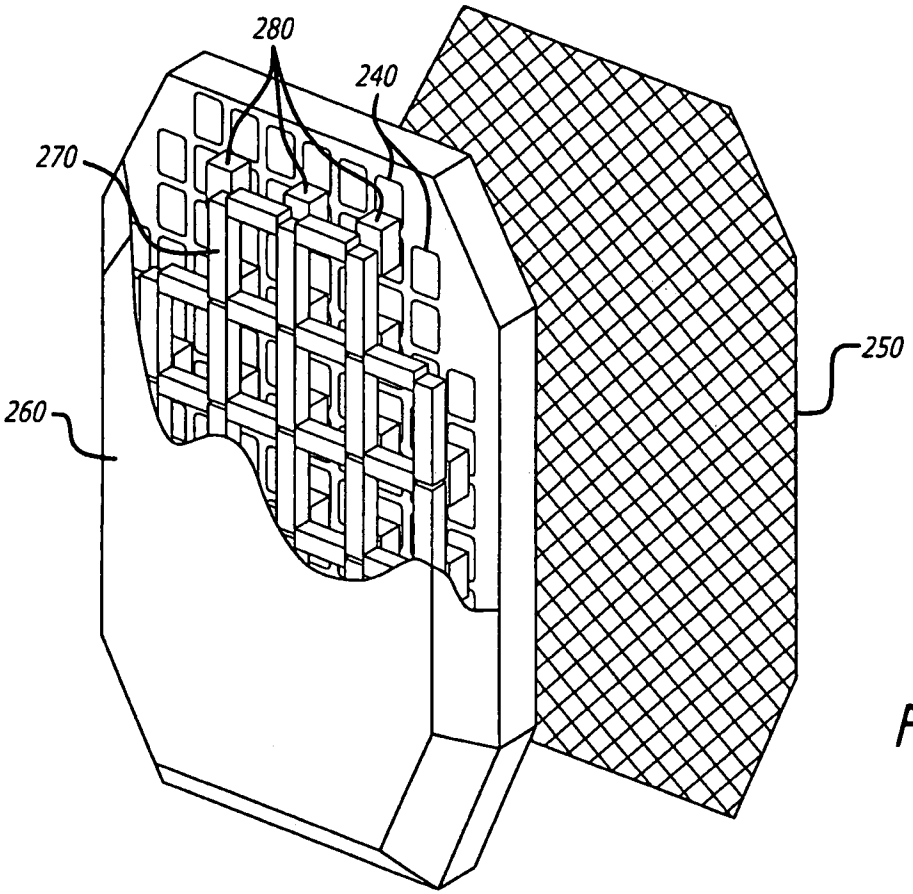
FIG. 7 is a multi-dimensional view of an astigmatic focusing system according to another embodiment of the present invention.

Beam-forming functions can also be performed by array radiators (flat-panel array antennas fed by a single or multiple high-power sources or arrays of active elements such as phased arrays), grid amplifiers, and grid oscillators. The phasing of the emission from the array can be such that the array radiates a curved wavefront, with the curvature not constrained to be the same magnitude or sign in the xz-plane and yz-plane. FIG. 7 shows an astigmatic focusing system 200 according to one embodiment of the present invention, in which a radiating array 240 can perform all or a portion of the beam processing function, depending on the intended range of the active denial apparatus 100 and the size of the aperture 250. Thus, the at least one beam processing element may be partially or fully combined with the high power millimeter-wave source 100. Consequently the present invention according to this embodiment contemplates a phased array millimeter-wave source 110, configured in aperture dimensions in the x-direction and y-direction and in effective focal point in the xz-plane and the yz-plane such that a desired beam profiles in the xz-plane and yz-plane are directly generated by the source without need for additional beam processing elements. The radiating array 240 of this embodiment of the present invention may be in the form of antenna array elements, and the phased array millimeter wave source 110 may also include a multi-feed flat panel antenna 260, a phasing network 270, and w-band injection locked sources 280.

The present invention also contemplates a system having two distinct focusing configurations, with two different sets of xz-plane and yz-plane beam profiles. These beam profiles could be optimized to deliver a desired power density range, high enough to be effective and low enough to avoid damage, over two distinct ranges along the axis of propagation (e.g., a range near the aperture of the system and an adjacent range further away). If the system's focal configuration were alternated between the two configurations, the system would alternately be delivering an effective power density to each of the two ranges. Provided the dwell time of the beam in each range and the duty cycle are sufficient to produce the desired effect, such a system can effectively cover both ranges along the axis of propagation. Such a system can use a lower peak power than a system that is required to deliver an effective level of power density over both ranges of distance simultaneously, which is a significant advantage. An active denial apparatus that can rapidly alternate between two focal configurations may be most simply realized with a system having a focal configuration that is modulated electronically, such as a phased array. Depending on the range requirements of the application, this may be realized using either a variable-focus array with no additional beam processing elements, or using a variable-focus array feeding additional shaped reflectors or lenses It is to be understood that a system could be configured to cycle through more than two focusing configurations, to further reduce the peak power requirements for the high power millimeter-wave source.

It is to be further understood that other embodiments may be utilized and structural and functional changes may be made without departing from the scope of the present invention. The foregoing descriptions of embodiments of the invention have been presented for the purposes of illustration and description. It is not intended to be exhaustive or to limit the invention to the precise forms disclosed. Accordingly, many modifications and variations are possible in light of the above teachings. For example, the present invention is scalable beyond a handheld device to a system of any size, and can be configured for mobile weapons systems. Additionally, the millimeter-wave source may comprise other types of energy sources such as other solid-state or vacuum tube-based sources. It is therefore intended that the scope of the invention be limited not by this detailed description.

The invention claimed is:

1. An active denial apparatus comprising:

a high-power millimeter wave source; and at least one beam-processing element for directing millimeter wave energy along an axis of propagation, the at least one beam-processing element including a variable focusing system delivering a substantially constant power density over the axis of propagation by alternating between at least two focusing configurations comprised of a focusing profile in which a focused, near-field beam is directed in a plane defined by a x-axis and a z-axis that includes the axis of propagation, and a substantially different focusing profile in which a focused, near-field beam is directed a plane defined by a y-axis and the z-axis also including the axis of propagation that is perpendicular to the x-plane, to enable effective operation of an active denial apparatus regardless of knowledge of a target's position across different ranges of distance in the axis of propagation.

2. The active denial apparatus of claim 1, wherein one or more of the at least two focusing configurations delivers a beam with an effective cross sectional area that is substantially constant over a wide range in an axis of propagation.

3. The active denial apparatus of claim 1, wherein the focused, near-field beam delivered by the variable focusing system diverges in the plane defined by a x-axis and a z-axis and converges in the plane defined by a y-axis and the z-axis.

4. The active denial apparatus of claim 1, wherein the at least two focusing configurations alternate the millimeter wave energy between a plurality of fixed focus settings having either different effective apertures, different effective focal lengths in the plane defined by the y-axis and the z-axis, the plane defined by the y-axis and the z-axis, or both, or both different effective apertures and effective focal lengths.

5. The active denial apparatus of claim 1, wherein the at least two focusing configurations are each configured to deliver an effective power density within a desired range of power densities over different ranges of distance in an axis of propagation.

6. The active denial apparatus of claim 1, wherein the at least one beam processing element includes at least one of a shaped reflector, shaped transmissive lens, flat-panel array antenna, or a phased array system, or any combination thereof.

7. The active denial apparatus of claim 1, wherein the high-power millimeter-wave source includes at least one of a solid-state source or a vacuum tube-based source.

8. The active denial apparatus of claim 7, wherein if the high-power millimeter-wave source includes a solid-state source, then the high-power millimeter-wave source also includes at least one of a grid amplifier or a grid oscillator, or any combination thereof.

9. A method of focusing energy in an active denial device comprising:

generating millimeter-wave energy from a high-power millimeter wave source; and directing millimeter wave energy along an axis of propagation, wherein at least one beam-processing element includes a variable focusing system delivering a substantially constant power density over the axis of propagation by alternating between at least two focusing configurations of a focusing profile in which a focused, near-field beam is directed in a plane defined by a x-axis and a z-axis that includes the axis of propagation, and a substantially different focusing profile in which a focused, near-field beam is directed a plane defined by a y-axis and the z-axis also including the axis of propagation that is perpendicular to the x-plane, to enable effective operation of an active denial apparatus regardless of knowledge of a target's position across different ranges of distance in the axis of propagation.

10. The method of claim 9, wherein one or more of the at least two focusing configurations delivers a beam with an effective cross sectional area that is substantially constant over a wide range in an axis of propagation.

11. The method of claim 9, wherein the focused, near-field beam delivered by the variable focusing system diverges in the plane defined by a x-axis and a z-axis and converges in the plane defined by a y-axis and the z-axis.

12. The method of claim 9, wherein the at least two focusing configurations alternate the millimeter wave energy between a plurality of fixed focus settings having either different effective apertures, different effective focal lengths in the plane defined by the y-axis and the z-axis, the plane defined by the y-axis and the z-axis, or both, or both different effective apertures and effective focal lengths.

13. The method of claim 9, wherein the at least two focusing configurations are each configured to deliver an effective power density within a desired range of power densities over different ranges of distance in an axis of propagation.

14. The method of claim 9, wherein the at least one beam processing element includes at least one of a shaped reflector, shaped transmissive lens, flat-panel array antenna, or a phased array system, or any combination thereof.

15. The method of claim 9, wherein the high-power millimeter-wave source includes at least one of a solid-state source or a vacuum tube-based source.

* * * * *